US007284968B2

(12) United States Patent
Tsai

(10) Patent No.: US 7,284,968 B2
(45) Date of Patent: Oct. 23, 2007

(54) BIDIRECTIONAL AIR PUMP

(75) Inventor: Lung-Po Tsai, Taipei Hsien (TW)

(73) Assignee: Ho Lee Co., Ltd., Taipei Hsien (TW)

( * ) Notice: Subject to any disclaimer, the term of this patent is extended or adjusted under 35 U.S.C. 154(b) by 620 days.

(21) Appl. No.: 10/950,464

(22) Filed: Sep. 28, 2004

(65) Prior Publication Data

US 2006/0073045 A1 Apr. 6, 2006

(51) Int. Cl.
*F04B 17/00* (2006.01)
*F04B 35/04* (2006.01)

(52) U.S. Cl. ..... 417/423.14; 417/423.1; 417/326; 417/234; 141/313; 5/713; 5/655.3; 251/129.15; 251/320

(58) Field of Classification Search ..... 417/423.1, 417/423.14; 251/149.6, 211, 326
See application file for complete search history.

(56) References Cited

U.S. PATENT DOCUMENTS 1,016,573 A * 2/1912 Maddon ..... 137/399
1,192,141 A * 7/1916 White ..... 405/106
2,005,443 A * 6/1935 Steele ..... 84/377
4,150,693 A * 4/1979 Genevey et al. ..... 137/625.3
4,331,420 A * 5/1982 Jones ..... 418/32
4,838,953 A * 6/1989 Pankowiecki ..... 137/625.3
6,237,653 B1 * 5/2001 Chaffee ..... 141/313
6,530,751 B1 * 3/2003 Song et al. ..... 417/26
6,543,073 B2 * 4/2003 Wu ..... 5/713
2004/0202559 A1 * 10/2004 Yen ..... 417/423.1
2006/0210413 A1 * 9/2006 Chung ..... 417/423.1

* cited by examiner

*Primary Examiner*—Mark Eashoo
*Assistant Examiner*—Drew Davidson
(74) *Attorney, Agent, or Firm*—Rosenberg, Klein & Lee

(57) ABSTRACT

A bidirectional air pump to selectively inflate or deflate an inflatable object has a housing, a pump assembly and a motor. The housing has a controller cover, a pump cover, and a motor cover. The pump assembly is mounted inside the housing and has a centrifugal pump, a binary supply/discharge valve assembly, a selectable check valve assembly and a valve controller. The motor is mounted inside the housing. The valve assembly and the motor cooperate to pump air into or draw air out of an air mattress or inflatable sofa.

2 Claims, 9 Drawing Sheets

BIDIRECTIONAL AIR PUMP

BACKGROUND OF THE INVENTION

1. Field of the Invention

The present invention relates to an air pump, and more particularly to a bidirectional air pump that selectively supplies air to or draws air from an air mattress or sofa.

2. Description of Related Art

Air pumps are used with air mattresses and air sofas. For example, an air mattress is made of soft material and usually has an internal chamber and a port that communicates with the internal chamber. A conventional air pump is attached selectively to the port. To use the mattress, sufficient air must be pumped into the internal chamber with the conventional air pump. The conventional air pump only pumps air into the internal chamber. To deflate the mattress, a user has to detach the conventional air pump from the port and manually press the outer surface of the mattress to discharge air from the internal chamber. However, deflating the mattress completely by hand is difficult and time-consuming.

To overcome the shortcomings, the present invention provides a bidirectional air pump to mitigate or obviate the aforementioned problems.

SUMMARY OF THE INVENTION

The main objective of the invention is to provide a bidirectional air pump that selectively pumps air into or draws air from a mattress or sofa.

A bidirectional air pump in accordance with the present invention to selectively inflate or deflate an inflatable object comprises a housing, a pump assembly and a motor. The pump assembly has a binary supply and discharge valve.

Other objectives, advantages and novel features of the invention will become more apparent from the following detailed description when taken in conjunction with the accompanying drawings.

DETAILED DESCRIPTION OF PREFERRED EMBODIMENT

Figure 1:
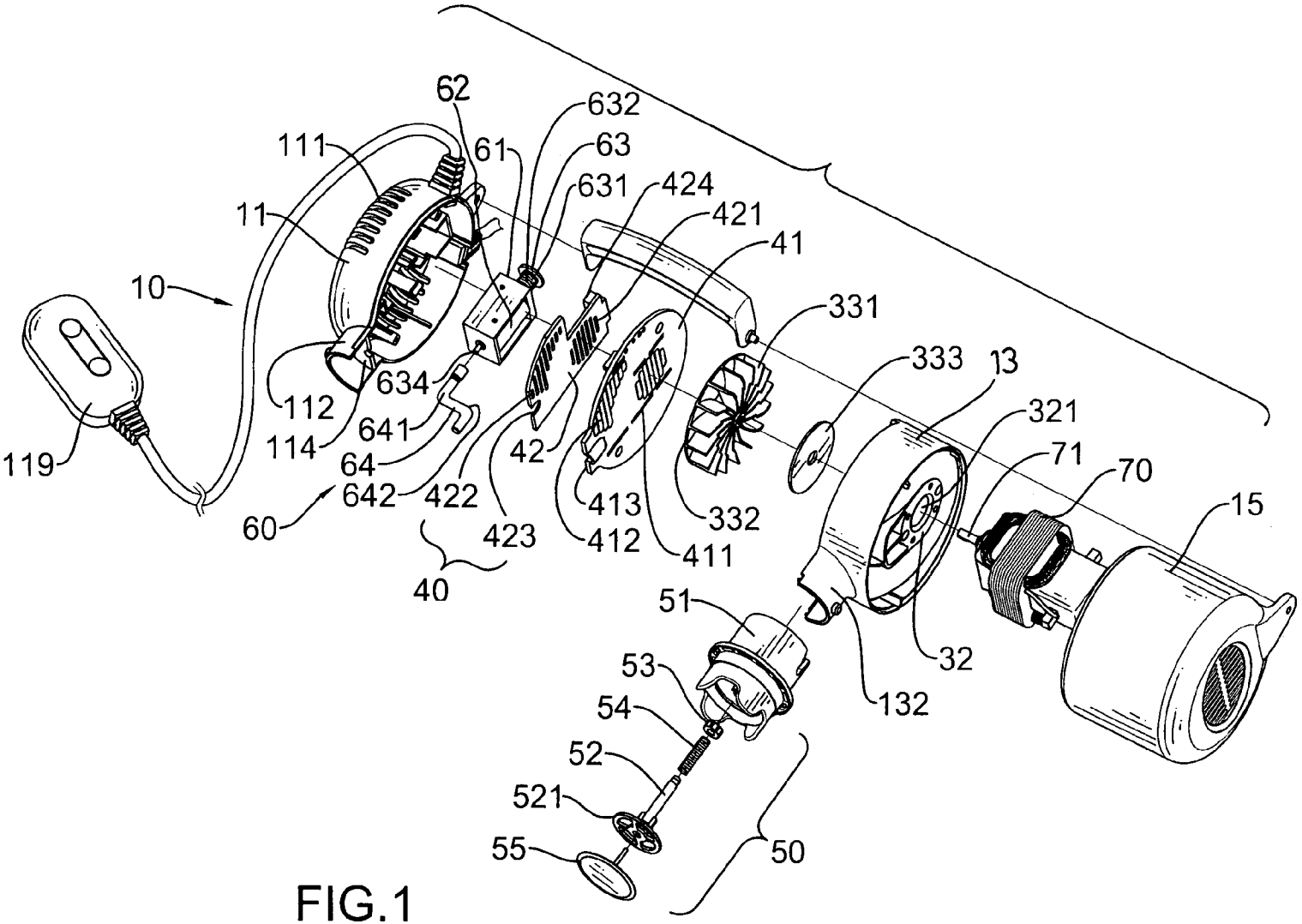
FIG. 1 is an exploded perspective view of a bidirectional air pump in accordance with the present invention.

With reference to FIG. 1, a bidirectional air pump in accordance with the present invention comprises a housing (10), a pump assembly and a motor (70).

The housing (10) has a controller cover (11), a pump cover (13), a motor cover (15) and an optional handle. The controller cover (11) has an end wall, a sidewall, an open end, a nipple half (112), an offset shaft bracket (114), multiple air vents (111) and a switch (119). The sidewall is formed around the end wall. The open end has an edge. The nipple half (112) is formed on the sidewall adjacent to the open end and has an inner surface. The offset shaft bracket (114) is formed radially on the inner surface of the nipple half (112) and has a central through hole. The multiple air vents (111) are defined through the controller cover (11). The switch (119) is attached to the sidewall of the controller cover (11).

Figure 2:
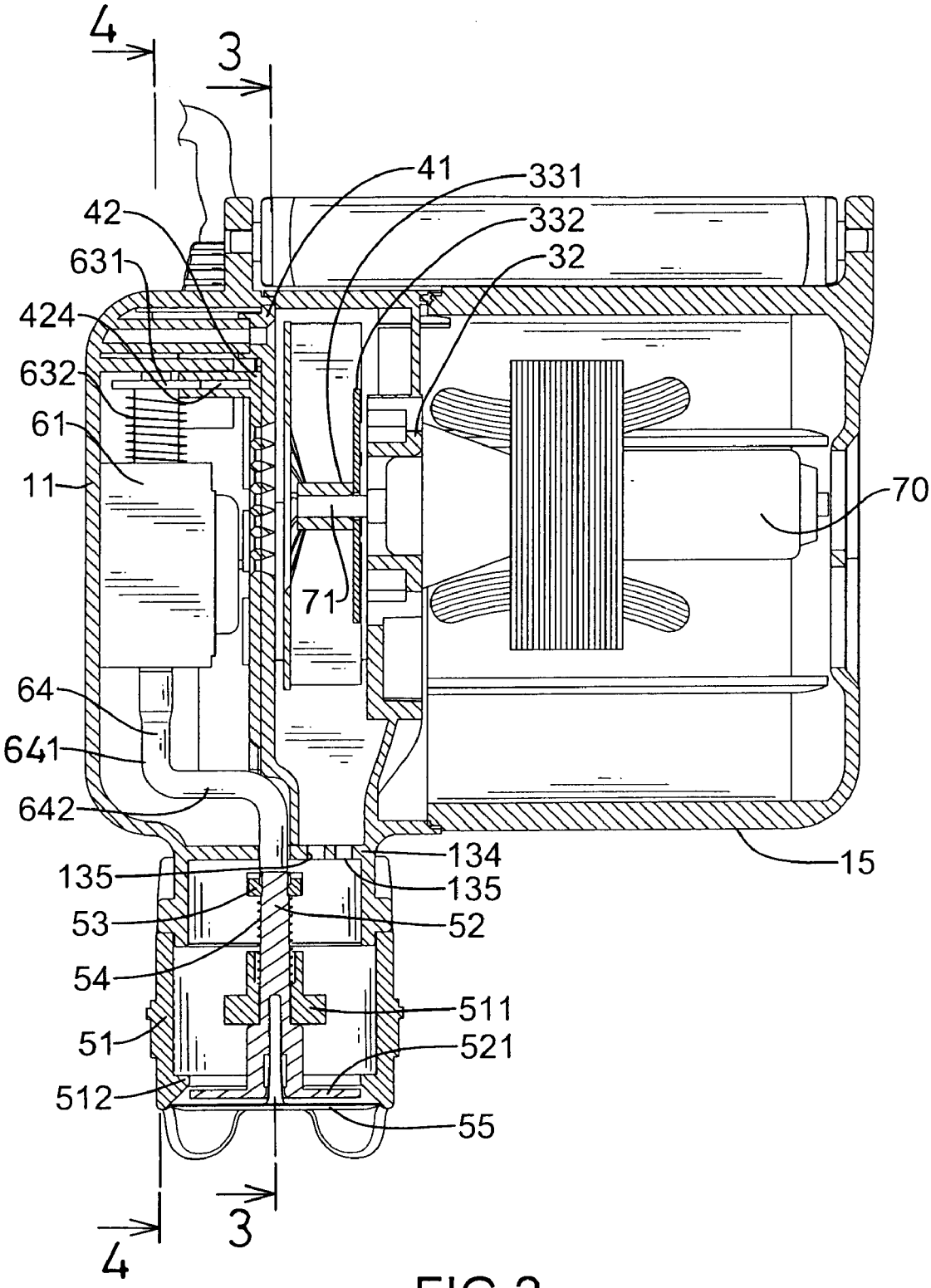
FIG. 2 is a bottom view in partial section of the bidirectional air pump in FIG. 1.

With further reference to FIG. 2, the pump cover (13) is connected to the edge of the controller cover (11) and has a cylindrical sidewall, a nipple half (132), an offset shaft bracket (134) and multiple air discharge holes (135). The cylindrical sidewall has an open left end and an open right end. The open left end has a left edge attached to the edge of the open end of the controller cover (11), and the open right end has a right edge. The nipple half (132) is formed on the cylindrical sidewall adjacent to the open left end, corresponds to the nipple half (112) on the controller cover (11) and has an inner surface. The offset shaft bracket (134) is formed radially on the inner surface of the nipple half (132) and corresponds to the offset shaft bracket (114) in the controller cover (11). The multiple air discharge holes (135) are defined through the offset shaft bracket (134) in the pump cover (13).

The motor cover (15) is attached to the right edge of the open right end of the pump cover (13) and has an open left end. The open left end of the motor cover (15) has a left edge attached to the right end of the pump cover (13).

The optional handle is pivotally attached to the controller cover (11) and motor cover (15).

The pump assembly is mounted inside the pump cover (13) and the controller cover (11) and has a centrifugal pump, a selectable supply and discharge valve assembly (40), a selectable check valve assembly (50) and a valve controller (60).

Figure 3:
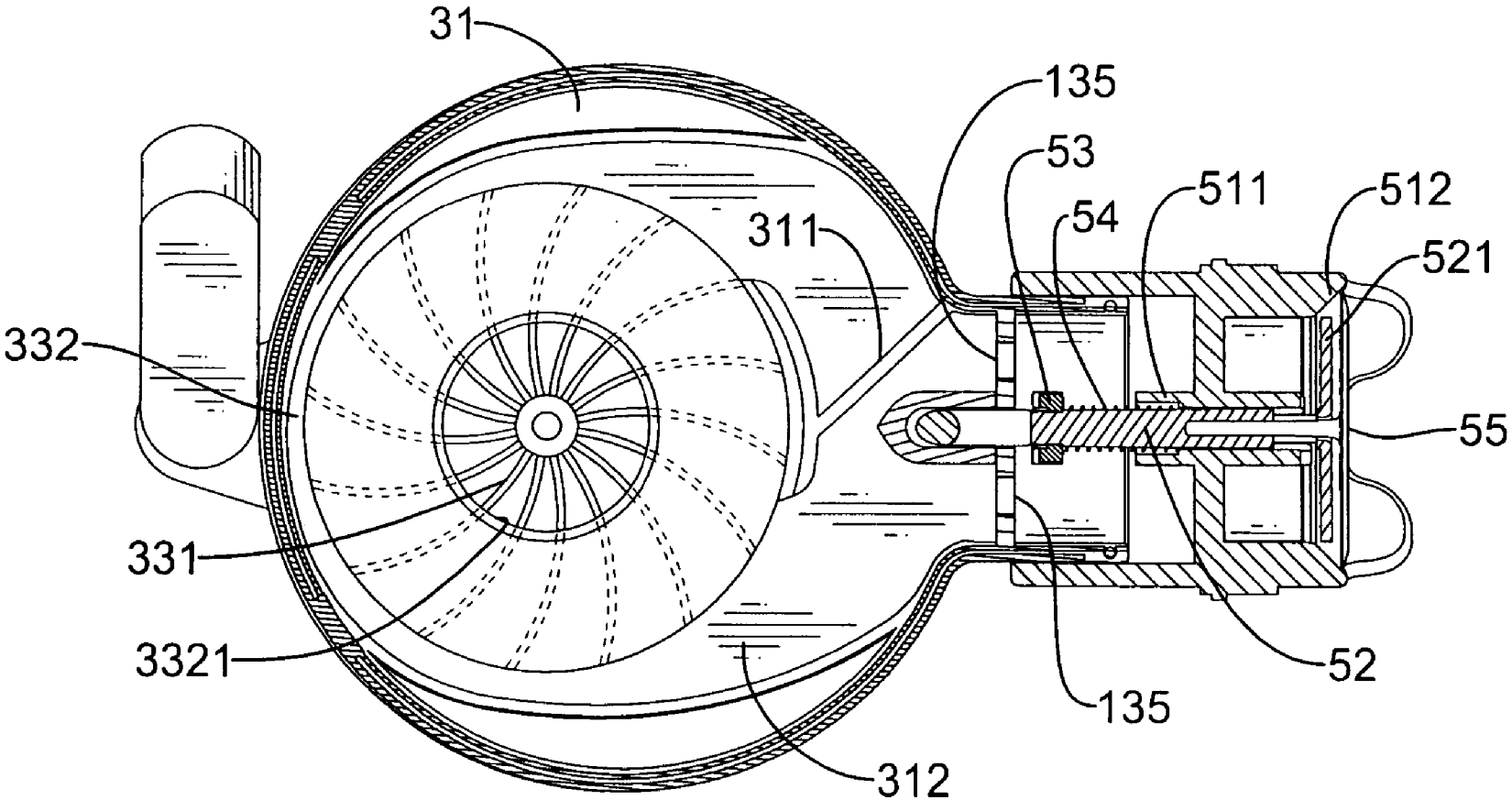
FIG. 3 is a left side view in partial section of the bidirectional air pump along line 3-3 in FIG. 2.
Figure 4:
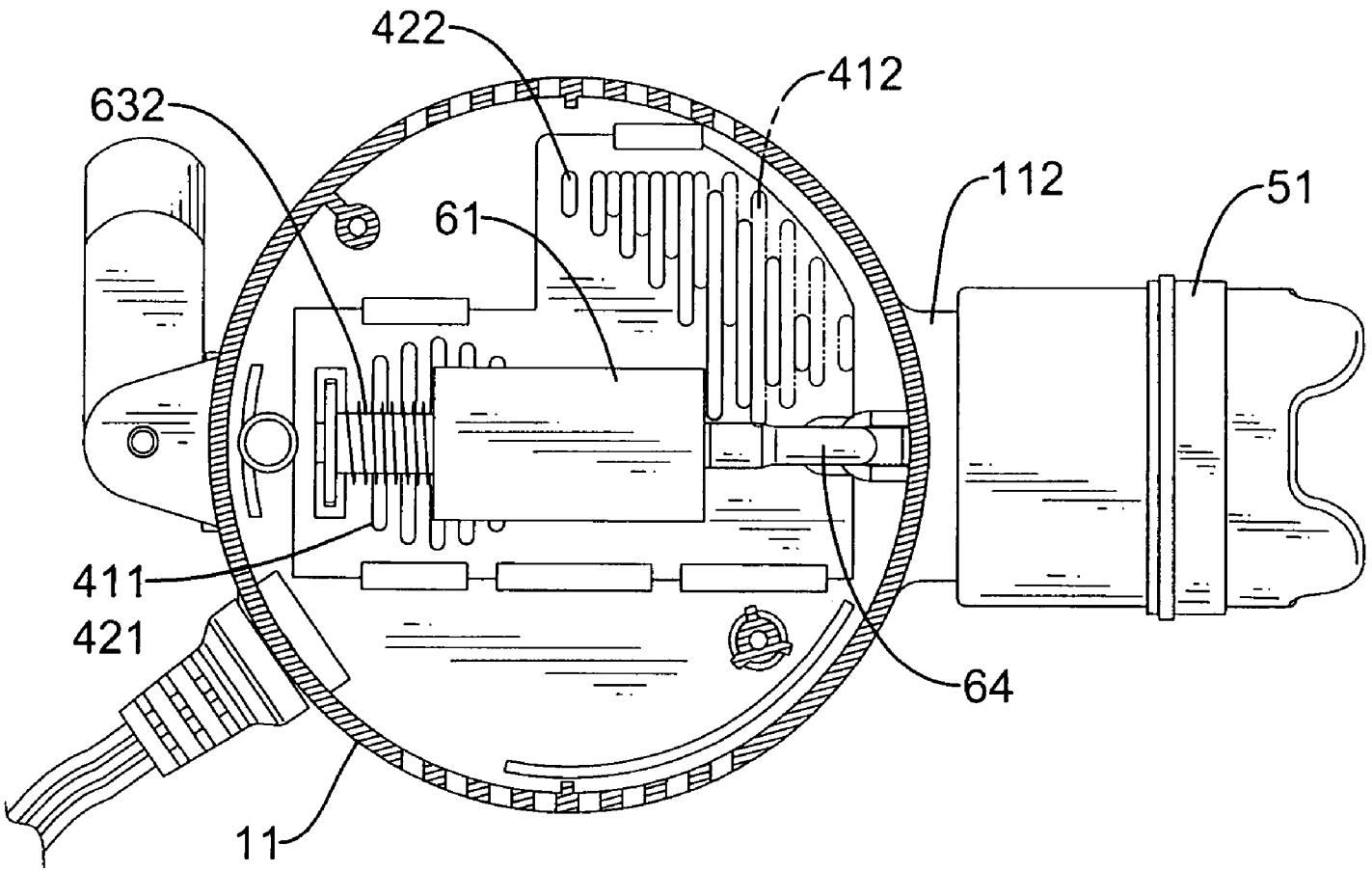
FIG. 4 is a left side view in partial section of the bidirectional air pump along line 4-4 in FIG. 2.

With reference to FIGS. 1 and 3, the centrifugal pump is mounted inside the pump cover (13) and has a volute (31), a motor bracket (32) and an impeller assembly.

The volute (31) is formed inside the pump cover (13) and has a volute passage (312) and an air channel wall (311). The volute passage (312) is defined inside the sidewall and communicates with the air discharge holes (135). The air channel wall (311) is formed in the volute (31) and has an inside end, an outside end and two sides and divides the volute passage (312) into a single non-circular path. The outside end is formed on the sidewall and extends inward at an angle.

The motor bracket (32) is formed inside the pump cover (13) on the volute (31) and has a mounting hole (321). The mounting hole (321) is defined through the motor bracket (32).

The impeller assembly is mounted rotatably inside the volute (31) and has an impeller (331), an inlet disk (332), a motor bracket seal (333) and multiple curved air passages. The impeller (331) is mounted inside the volute (31) and has a left side, a right side, multiple impeller blades and a central hole. The inlet disk (332) is mounted concentrically on the left side of the impeller (331) and has a central air hole (3321). The motor bracket seal (333) is mounted concentrically on the right side of the impeller (331) and has a central hole. The curved air passages are defined respectively between adjacent impeller blades with the motor bracket seal (333) and the inlet disk (332) and communicate with the central air hole (3321).

The selectable supply and discharge valve assembly (40) is mounted inside the housing (10) and has an internal dividing wall (41) and a movable valve wall (42).

The internal dividing wall (41) is mounted inside the controller cover (11) against the open end and has a left side surface, a right side surface, an outer edge, multiple air supply slots (411), multiple air discharge slots (412) and a recess (413). The air supply slots (411) are defined through the internal dividing wall (41), have a width and are arranged at intervals. The interval between adjacent air supply slots (411) is equal to the width of the air supply slots (411). The air discharge slots (412) are defined through the internal dividing wall (41) adjacent to the outer edge, have a width and are arranged at intervals. The interval between adjacent air discharge slots (412) is equal to the width of the air discharge slots (412). The recess (413) is defined on the left side surface of the internal dividing wall (41) and corresponds to the central through hole in the offset shaft bracket (114).

With reference to FIGS. 1 and 2, the movable valve wall (42) is slidably mounted on the left side surface of the internal dividing wall (41) and has a left side surface, a right side surface, an outer edge, multiple air supply slots (421), multiple air discharge slots (422), a notch (423) and a mounting recess (424). The air supply slots (421) are defined through the movable valve wall (42) and correspond to and selectively align with the air supply slots (411) in the internal dividing wall (41). The air discharge slots (422) are defined through the movable valve wall (42) and correspond to and selectively align with the air discharge slots (412) in the internal dividing wall (41). However, the discharge slots (422) will not align with the discharge slots (412) in the internal dividing wall (41) when the air supply slots (421) are aligned with the air supply slots (411) in the internal dividing wall (41). The notch (423) is defined on the outer edge of the movable valve wall (42). The mounting recess (424) is defined on the left side surface.

With reference to FIGS. 1 and 2, the selectable check valve assembly (50) is mounted on the housing (10) and has a valve body (51), a valve rod (52), a stop (53), a spring (54) and a diaphragm (55).

The valve body (51) is mounted on the housing (10) and has an open back, an open front, an inner surface and an inner bushing (511). The open back of the valve body (51) is mounted around the nipple halves (112, 132). The open front of the valve body (51) has a front edge (512). The inner bushing (511) is mounted inside the valve body (51) on the inner surface and has an open back end, an open front end and a central hole.

The valve rod (52) is mounted through the central hole in the inner bushing (511) and has a back end, a front end and a diaphragm grid frame (521). The back end extends out of the open back end of the inner bushing (511). The diaphragm grid frame (521) is mounted at the front end of the valve rod (52). The stop (53) is mounted around the back end of the valve rod (52) close to the open back end of the inner bushing (511). The spring (54) is mounted around the valve rod (52) and has two ends pressing respectively against the stop (53) and the open back end of the inner bushing (511). The diaphragm (55) is made of resilient material, is mounted on the diaphragm grid frame (521) and corresponds hermetically to the front edge in the valve body (51).

The valve controller (60) is mounted inside the controller cover (11), is connected to the movable valve wall (42) and has a solenoid casing (61), a coil (62), a linear rod (63) and an offset shaft (64).

The solenoid casing (61) is mounted securely inside the controller cover (11) and has a back, a front and an open right side.

The coil (62) is electrically connected to the switch (119) and is mounted inside the solenoid casing (61).

The linear rod (63) is mounted slidably through the front and back of the solenoid casing (61), extends through the coil (62) and has a back end, a front end (634), a mounting disk (631) and a spring (632). The front end (634) and the back end of the linear rod (63) respectively extend out of the front and the back of the solenoid casing (61). The mounting disk (631) may be made of metal, is mounted on the back end of the linear rod (63) and is inserted partially into the mounting recess (424).

The spring (632) is mounted around the linear rod (63) between the mounting disk (331) and the back of the solenoid casing (61) and has two ends pressing respectively against the mounting disk (631) and the back of the solenoid casing (61).

The offset shaft (64) is attached to the front end (634) of the linear rod (63) and has a mounting segment (641), a transverse segment (642) and a drive segment. The mounting segment (641) has a back end attached to the front end (634) of the linear rod (63) and a front end. The transverse segment (642) is defined at the front end of the mounting segment (641), is perpendicular to the mounting segment (641), passes through the notch (423) in the movable valve wall (42) and has a left end and a right end. The left end of the transverse segment (642) is defined on the front end of the mounting segment (641), and the right end of the transverse segment (642) is adjacent to the recess (413) in the internal dividing wall (41). The drive segment is defined on the right end of the transverse segment (642), is parallel to the mounting segment (641), corresponds to the recess (413) in the internal dividing wall (41) and has a distal end abutting the back end of the valve rod (52).

The motor (70) is mounted inside the motor cover (15), is connected electrically to the switch (119), operates in two directions by adjusting the switch (119) and has a left end and a drive shaft (71). The left end extends into the mounting hole (321) in the motor bracket (32). The drive shaft (71) extends from the left end of the motor (70), is mounted securely in the central hole of the impeller (331), extends through the central hole in the motor bracket seal (333) and rotates in two directions depending on the operation of the motor (70).

In use and operation, the bidirectional air pump can be attached to an air mattress or an inflatable sofa. The valve body (51) hermetically engages a port defined in the mattress or sofa and pumps air into or draws air out of an internal chamber inside the mattress or sofa.

Figure 5:
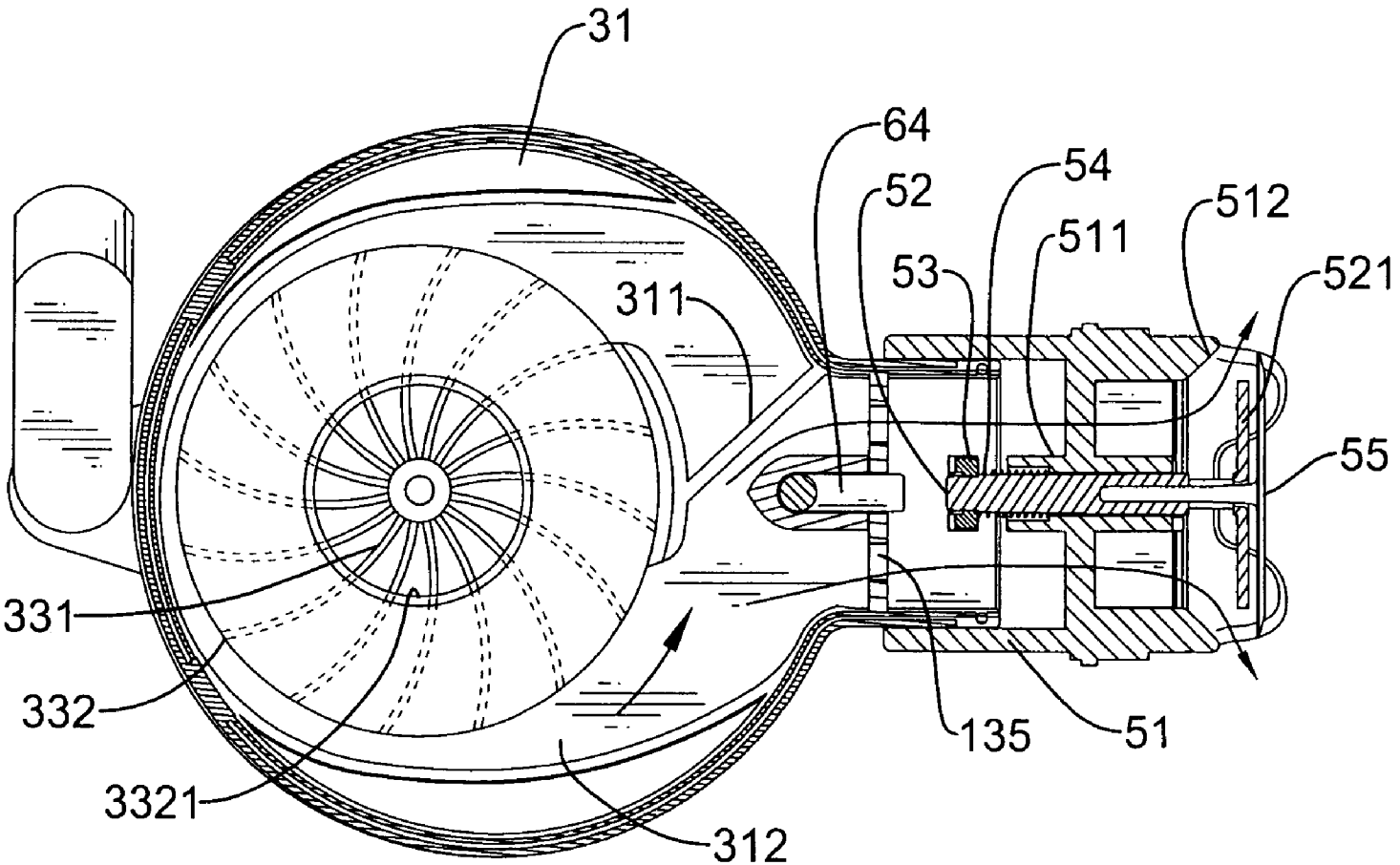
FIG. 5 is an operational left side view in partial section of the bidirectional air pump in FIG. 3 configured to pump air into an air mattress or sofa.
Figure 6:
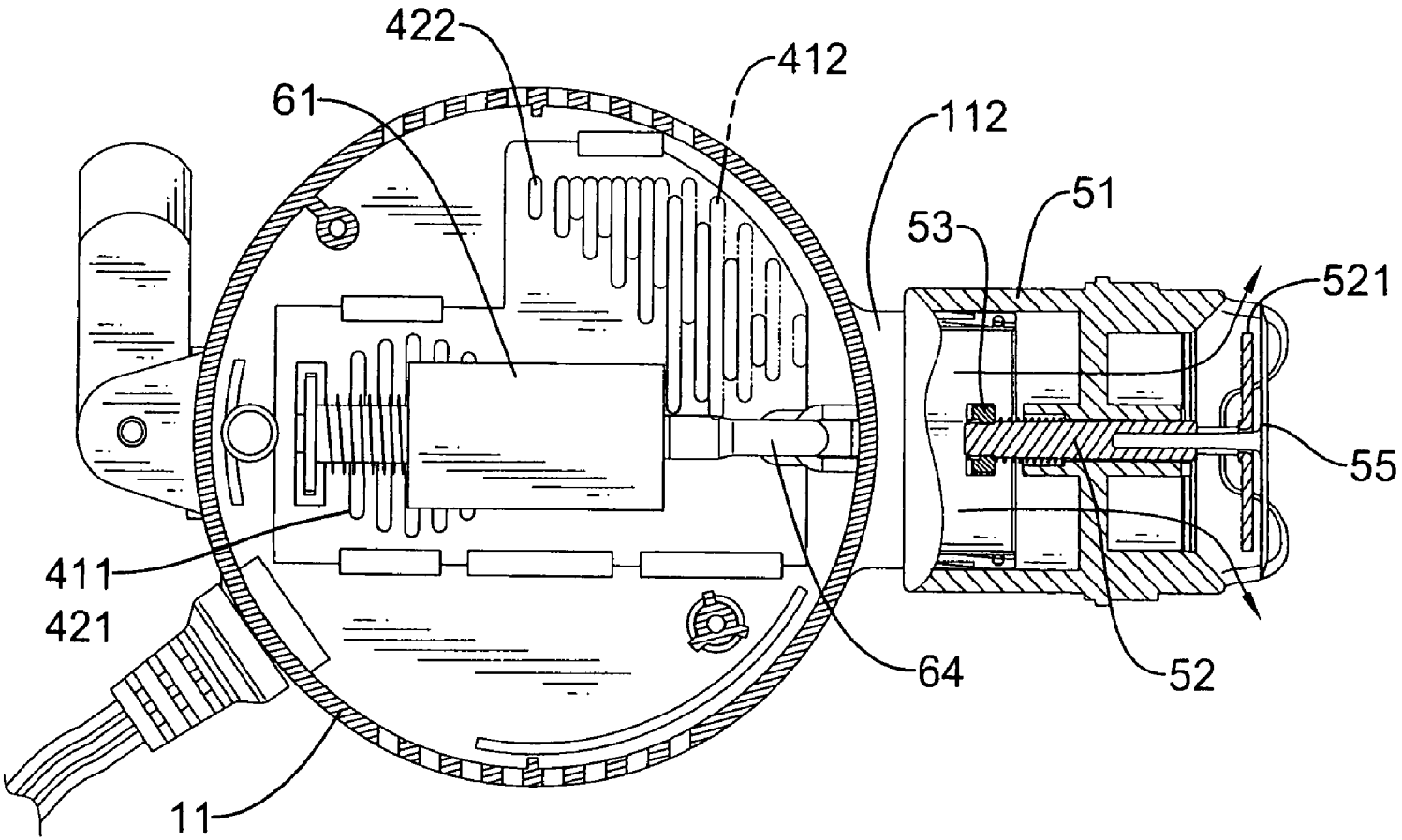
FIG. 6 is an operational left side view in partial section of the bidirectional air pump in FIG. 4 configured to pump air into an air mattress or sofa.

With reference to FIGS. 5 and 6, the bidirectional air pump pumps air into the internal chamber of the mattress or sofa when the air supply slots (421) in the movable valve wall (42) are aligned with the air supply slots (411) in the internal dividing wall (41) and the impeller (331) is rotated counterclockwise. The switch (119) is adjusted to turn on the motor (70) and rotate the drive shaft (71) and the impeller (331) counterclockwise. The ambient air passes through the air vents (111) into the controller cover (11). Since the coil (62) is not electrified, the spring (632) presses against the mounting disk (631), and the linear rod (34) pulls the offset shaft (64) toward the solenoid casing (61). The offset shaft (64) in the recess (413) in the internal dividing wall (41) pulls the solenoid casing (61) and the movable wall (42) forward and aligns the air supply slots (421) in the movable valve wall (42) with the air supply slots (411) in the internal dividing wall (41). Then the air is allowed to pass through the air supply slots (421, 411) and the central air hole (3321) in the inlet disk (332) into the volute passage (312). The air passes through the air discharge hole (135) in the offset shaft bracket (134) and press against the diaphragm grid frame (521) on the valve rod (52). The valve rod (52) moves forward with the diaphragm (55) to form a clearance between the diaphragm (55) and the front edge of the valve body (51). Finally, the air passes through the clearance and the port into the internal chamber of the mattress or sofa.

Figure 7:
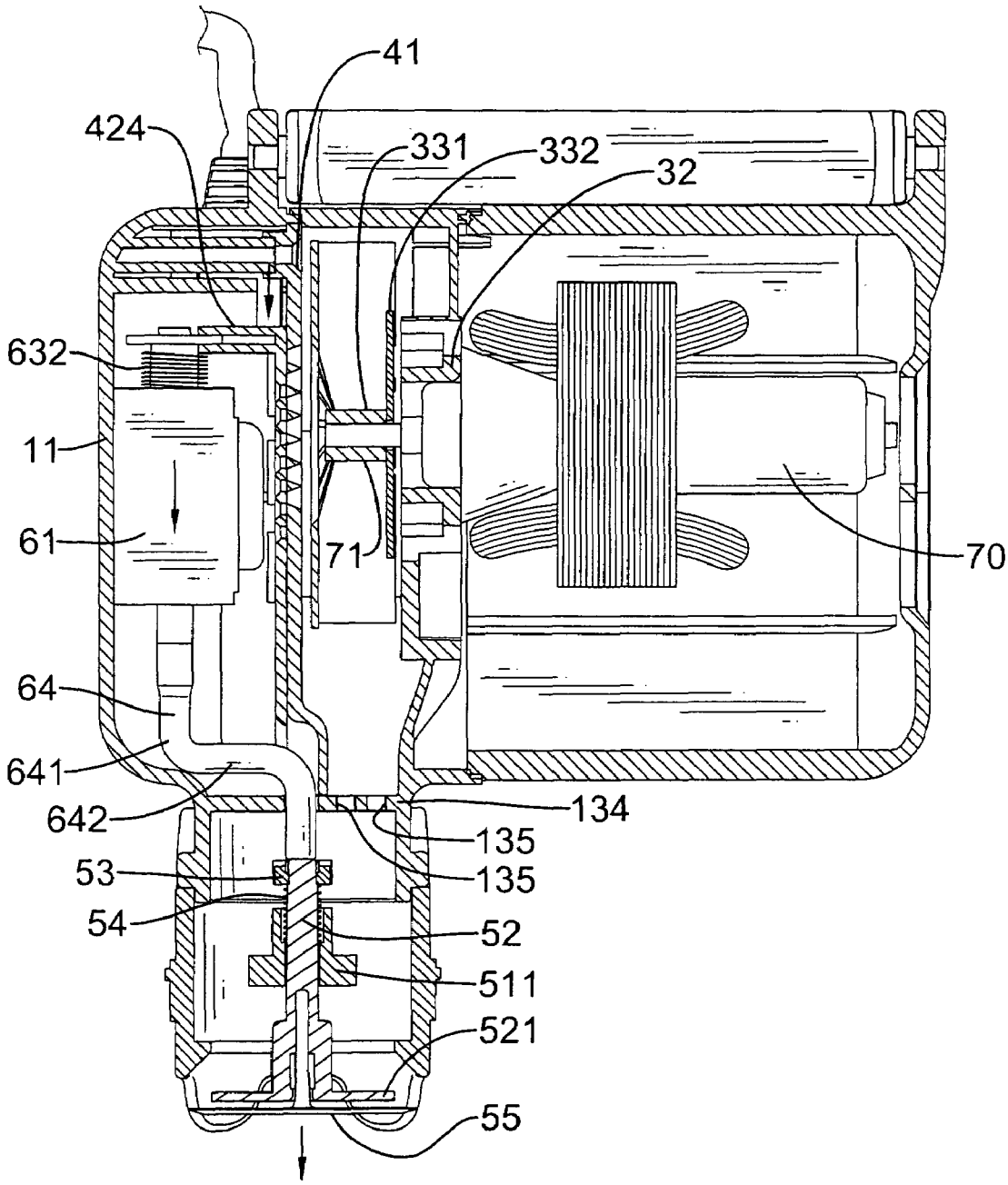
FIG. 7 is an operational bottom view in partial section of the bidirectional air pump in FIG. 2 configured to draw air out of an air mattress or sofa.
Figure 8:
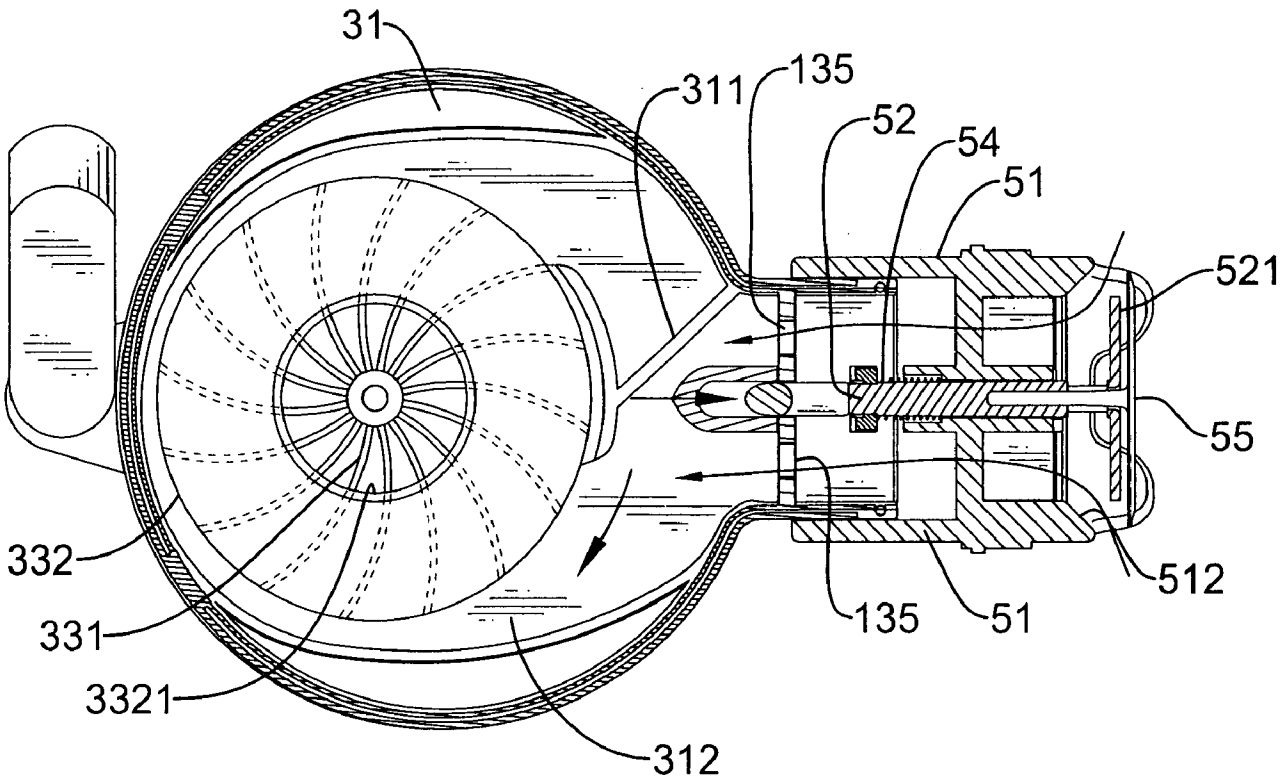
FIG. 8 is an operational left side view in partial section of the bidirectional air pump in FIG. 3 configured to draw air out of an air mattress or sofa.
Figure 9:
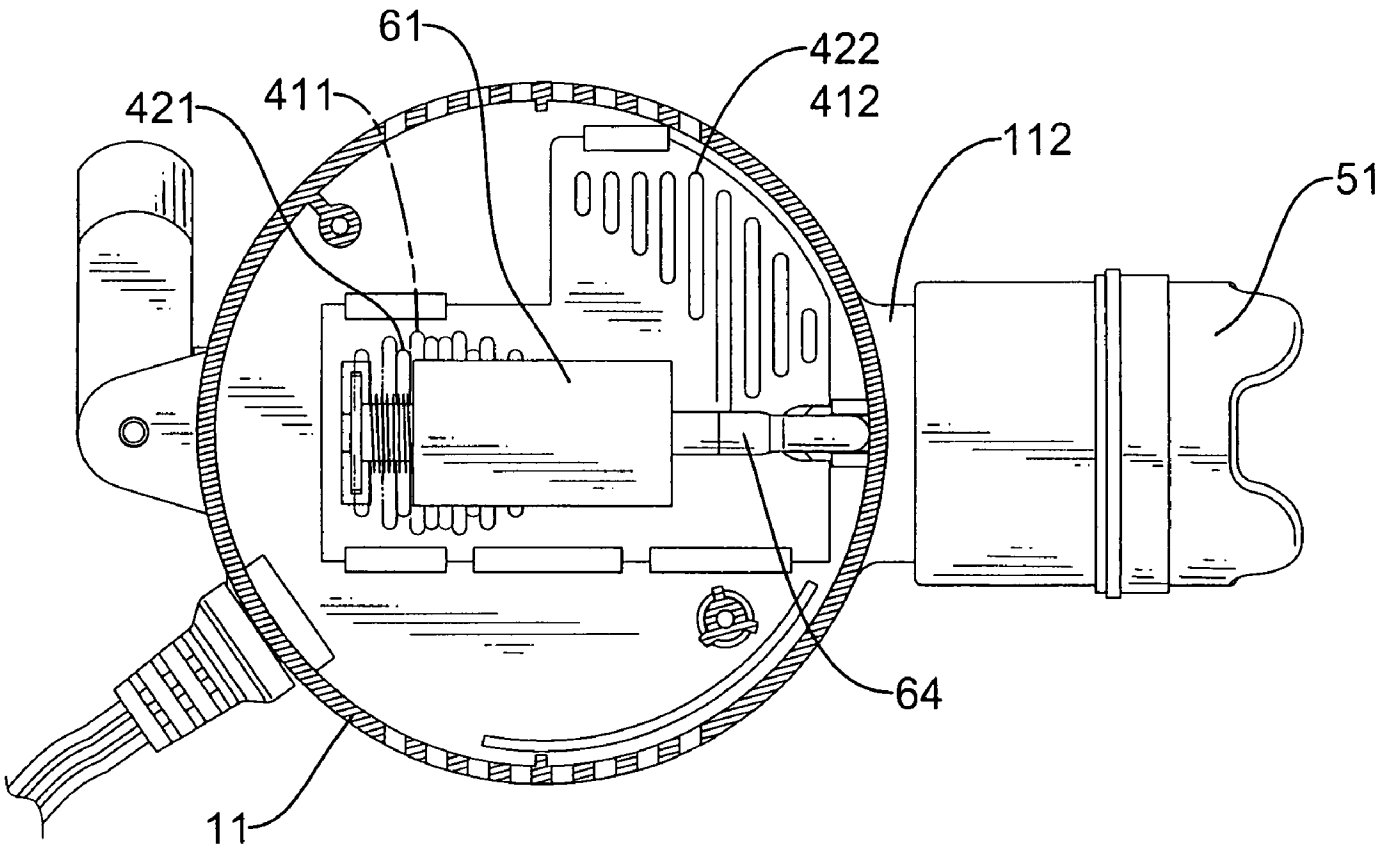
FIG. 9 is an operational left side view in partial section of the bidirectional air pump in FIG. 3 configured to draw air out of an air mattress or sofa.

With reference to FIGS. 7 to 9, the bidirectional air pump draws air out of the internal chamber of the mattress or sofa when the air discharge slots (422) in the movable valve wall (42) are aligned with the air discharge slots (412) in the internal dividing wall (41) and the impeller (331) is rotated clockwise. The switch (119) is adjusted to turn on the motor (21) and rotate the drive shaft (71) and the impeller (331) clockwise, and the coil (62) is electrified at the same time. The electrified coil (62) pulls the linear rod (63), the solenoid casing (61) and the movable wall (42) forward, which aligns the air discharge slots (422) in the movable valve wall (42) with air discharge slots (412) in the internal dividing wall (41). The offset shaft (64) moves forward with the distal end of the drive segment pushing the back end of the valve rod (52). The valve rod (52) moves forward with the diaphragm (55) to form a clearance between the diaphragm (55) and the front edge (512) in the valve body (51). Then the air inside the internal chamber of the inflated mattress or sofa is drawn by the rotating impeller (331) through the clearance and the air discharge hole (135) in the offset shaft bracket (134) into the volute passage (312). The air passes through the volute passage (312) and the aligned air discharge slots (422, 412) into the controller cover (11). Finally, the air passes through the air vents (111) in the controller cover (11) and is discharged out of the housing (10).

The bidirectional air pump can selectively pump air into or draw air out of an air mattress or inflatable sofa with the motor (70) and the valve assembly. Therefore, completely inflating or deflating an air mattress or inflatable sofa is easy and significantly less time-consuming.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A bidirectional air pump comprising:

a housing having a controller cover having an end wall;

a sidewall formed around the end wall;

an open end having an edge;

a nipple half formed on the sidewall adjacent to the open end and having an inner surface;

an offset shaft bracket formed radially on the inner surface of the nipple half and having a central through hole;

multiple air vents defined through the controller cover; and a switch attached to the sidewall of the controller cover;

a pump cover connected to the edge of the controller cover and having a cylindrical sidewall having an open right end having a right edge; and an open left end having a left edge attached to the edge of the open end of the controller cover;

a nipple half formed on the cylindrical sidewall adjacent to the open left end, corresponding to the nipple half on the controller cover and having an inner surface;

an offset shaft bracket formed radially on the inner surface of the nipple half and corresponding to the offset shaft bracket in the controller cover; and multiple air discharge holes defined through the offset shaft bracket in the pump cover; and a motor cover mounted on the right edge of the open right end of the pump cover and having an open left end having a left side edge attached to the right end of the pump cover;

a pump assembly mounted inside the pump cover and the controller cover and having a centrifugal pump mounted inside the pump cover and having a volute formed inside the pump cover and having a volute passage defined inside the sidewall and communicating with the air discharge holes; and an air channel wall formed in the volute, dividing the volute passage into a single non-circular path and having an inside end, an outside end and two sides, wherein the inside end is formed on the sidewall and extends inward at an angle;

a motor bracket formed inside the pump cover on the volute and having a mounting hole defined through the motor bracket; and an impeller assembly mounted rotatably inside the volute and having an impeller mounted inside the volute and having a left side, a right side, multiple impeller blades and a central hole;

an inlet disk mounted concentrically on the left side of the impeller and having a central air hole;

a motor bracket seal mounted concentrically on the right side of the impeller and having a central hole; and multiple curved air passages defined respectively between adjacent impeller blades with the motor bracket seal and the inlet disk and communicating with the central air hole;

a selectable supply and discharge valve assembly mounted inside the housing and having an internal dividing wall mounted inside the controller cover against the open end and having a left side surface;

a right side surface;

an outer edge;

multiple air supply slots defined through the internal dividing wall, having a width and arranged at intervals equal to the width of the air supply slots;

multiple air discharge slots defined through the internal dividing wall adjacent to the outer edge, having a width and arranged at intervals equal to the width of the air discharge slots; and a recess defined on the left side surface of the internal dividing wall and corresponding to the central through hole in the offset shaft bracket; and a movable valve wall slidably mounted on the left side surface of the internal dividing wall and having a left side surface;

a right side surface;

an outer edge;

multiple air supply slots defined through the movable valve wall and corresponding to and selectively aligning with the air supply slots in the internal dividing wall;

multiple air discharge slots defined through the movable valve wall and corresponding to and selectively aligning with the air discharge slots in the internal dividing wall but not aligning with the air discharge slots when the air supply slots are aligned with the air supply slots in the internal dividing wall;

a notch defined on the outer edge of the movable valve wall; and a mounting recess defined on the left side surface; and a selectable check valve assembly mounted on the housing and having a valve body mounted on the housing and having an open back mounted around the nipple halves;

an open front having a front edge;

an inner surface; and an inner bushing mounted inside the valve body on the inner surface and having an open back end, an open front end and a central hole;

a valve rod mounted through the central hole in the inner bushing and having a back end extending out of the open back end of the inner bushing;

a front end; and a diaphragm grid frame mounted at the front end of the valve rod;

a stop mounted around the back end of the valve rod close to the open back end of the inner bushing;

a spring mounted around the valve rod and having two ends pressing respectively against the stop and the open back end of the inner bushing; and a diaphragm made of resilient material, mounted on the diaphragm grid frame and corresponding hermetically to the front edge in the valve body; and a valve controller mounted inside the controller cover, connected to the movable valve wall and having a solenoid casing mounted securely inside the controller cover and having a back, a front and an open right side;

a coil electrically connected to the switch and mounted inside the solenoid casing;

a linear rod mounted slidably through the front and the back of the solenoid casing, extending through the coil and having a back end extending out of the back of the solenoid casing;

a front end extending out of the front of the solenoid casing;

a mounting disk mounted on the back end of the linear rod and inserted partially into the mounting recess; and a spring mounted around the linear rod between the mounting disk and the back of the solenoid casing and having two ends respectively pressing against the mounting disk and the back of the solenoid casing; and an offset shaft mounted at the front end of the linear rod and having a mounting segment having a back end attached at the front end of the linear rod and a front end;

a transverse segment defined at the front end of the mounting segment, being perpendicular to the mounting segment, passing through the notch in the movable valve wall and having a left end defined on the front end of the mounting segment; and a right end adjacent to the recess in the internal dividing wall; and a drive segment defined on the right end of the transverse segment, being parallel to the mounting segment, corresponding to the recess in the internal dividing wall and having a distal end abutting the back end of the valve rod; and a motor mounted inside the motor cover, connected electrically to the switch, operating in two directions by adjusting the switch and having a left end extending into the mounting hole of the motor bracket; and a drive shaft mounted extending from the left side end of the motor through the central hole in the motor bracket seal, mounted securely in the central hole in the impeller and rotating in two directions depending on the operation of the motor.

2. The bidirectional air pump as claimed in claim 1, wherein the casing assembly further comprises a handle pivotally mounted on the left side and right side casing.

* * * * *